US007957538B2

(12) United States Patent
Cho

(10) Patent No.: US 7,957,538 B2
(45) Date of Patent: Jun. 7, 2011

(54) METHOD AND APPARATUS TO DECODE AUDIO MATRIX

(75) Inventor: Sung-ho Cho, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 422 days.

(21) Appl. No.: 12/128,825

(22) Filed: May 29, 2008

(65) Prior Publication Data

US 2009/0129603 A1 May 21, 2009

(30) Foreign Application Priority Data

Nov. 15, 2007 (KR) ..... 10-2007-0116771

(51) Int. Cl.
*H04R 5/00* (2006.01)

(52) U.S. Cl. ..... 381/22; 381/20; 381/300

(58) Field of Classification Search ..... 381/20, 381/22, 300, 307, 310
See application file for complete search history.

(56) References Cited

U.S. PATENT DOCUMENTS

| | | | | |
|---|---|---|---|---|
| 770,230 | A * | 9/1904 | Forrest, Jr. | 377/92 |
| 4,799,260 | A | 1/1989 | Mandell et al. | |
| 6,023,512 | A * | 2/2000 | Matsuo et al. | 381/17 |
| 6,072,878 | A * | 6/2000 | Moorer | 381/18 |
| 6,269,166 | B1 * | 7/2001 | Matsuo et al. | 381/310 |
| 6,553,121 | B1 * | 4/2003 | Matsuo et al. | 381/17 |
| 6,904,152 | B1 * | 6/2005 | Moorer | 381/18 |
| 7,394,903 | B2 * | 7/2008 | Herre et al. | 381/23 |
| 7,447,317 | B2 * | 11/2008 | Herre et al. | 381/23 |
| 7,606,373 | B2 * | 10/2009 | Moorer | 381/18 |
| 7,761,304 | B2 * | 7/2010 | Faller | 704/502 |
| 2004/0125967 | A1 | 7/2004 | Eid et al. | |
| 2004/0247135 | A1 | 12/2004 | Dressler et al. | |
| 2005/0031143 | A1 * | 2/2005 | Devantier et al. | 381/300 |
| 2006/0045295 | A1 * | 3/2006 | Kim | 381/310 |
| 2006/0153408 | A1 * | 7/2006 | Faller et al. | 381/307 |
| 2007/0195964 | A1 * | 8/2007 | Yokota | 381/26 |
| 2008/0008327 | A1 * | 1/2008 | Ojala et al. | 381/20 |

FOREIGN PATENT DOCUMENTS

| | | |
|---|---|---|
| WO | 02-19768 | 3/2002 |

* cited by examiner

*Primary Examiner* — Vivian Chin
*Assistant Examiner* — Friedrich Fahnert
(74) *Attorney, Agent, or Firm* — Stanzione & Kim, LLP

(57) ABSTRACT

A method of audio matrix decoding in which a moving sound image is restored includes decoding multichannel signals from stereo signals, extracting strengths and positions of virtual sound sources existing between channels based on power vectors of the decoded multichannel signals, comparing the strengths and positions of the extracted previous and current virtual sound sources to predict position movement and the strengths of the virtual sound sources, and redistributing powers to positions of channel speakers in a multichannel arrangement based on the predicted position of a sound image.

17 Claims, 11 Drawing Sheets

METHOD AND APPARATUS TO DECODE AUDIO MATRIX

CROSS-REFERENCE TO RELATED APPLICATIONS

This application claims priority under 35 U.S.C. §119(a) from Korean Patent Application No. 10-2007-0116771, filed on Nov. 15, 2007, in the Korean Intellectual Property Office, the disclosure of which is incorporated herein in its entirety by reference.

BACKGROUND OF THE INVENTION

1. Field of the Invention

The present general inventive concept relates to an audio reproduction system, and more particularly, to a method and apparatus to decode audio matrix in which a moving sound image is restored by using an audio reproducing device such as a digital television (DTV) or audio-video (AV) receiver.

2. Description of the Related Art

Traditionally, when a user wanted to see a movie or the like at home, the user could see, for example, a movie through ground wave broadcasting from a television broadcast, etc. However, recently, the user can listen to an original sound of a movie, etc., due to the spread of video tapes, video discs or satellite broadcasting. In video tapes, video discs and satellite broadcasting in which the user listens to the original sound of the movie, audio signals of a plurality of channels are matrix-processed to be encoded as audio signals of two channels. In addition, when a dedicated decoder is used, audio signals of five channels such as front left (L), center (C), front right (R), left surround (Ls), and right surround (Rs) are restored from audio signals of two channels. Due to center channel signals of the audio signals of five channels, a sense of localization which is definitude of a sound can be obtained, and due to surround channel signals, a sense of presence is improved due to a moving sound, an environment sound, and a remaining sound, etc.

A matrix decoder that has been generally used, generates center channel signals and surround channel signals by using a sum of two channel signals and a difference therebetween. An audio matrix decoder in which matrix characteristics are not changed is well known as a passive matrix decoder. When each channel signal separated by the passive matrix decoder is encoded, audio signals of other channels are scaled-down together with corresponding channel audio signals and are linearly combined. Thus, signals of channels output to a conventional passive matrix decoder have low separation between channels so that localization of a sound image is not clearly achieved in a multichannel environment. An active matrix decoder adaptively changes matrix characteristics so as to improve separation between two-channel matrix symbol type encoding signals.

A technology relating to such matrix decoder is disclosed in U.S. Pat. No. 4,799,260 (filed 6 Feb. 1986, entitled VARIABLE MATRIX DECODER), WO 02/19768 A2 (filed 31 Aug. 2000, entitled METHOD FOR APPARATUS FOR AUDIO MATRIX DECODING).

Referring to FIG. 1, in a conventional matrix decoder, gain function units 110 and 116 clip input signals so as to balance levels of stereo signals Rt and Lt. A passive matrix function unit 120 outputs passive matrix signals from stereo signals R't and L't output from the gain function units 110 and 116. A variable gain signals generator 130 generates six control signals gL, gR, gF, gB, gLB, and gRB in response to the passive matrix signals generated in the passive matrix function unit 120. A matrix coefficient generator 132 generates twelve matrix coefficients in response to six control signals generated in the variable gain signals generator 130. An adaptive matrix function unit 114 generates output signals L, C, R, L, Ls, and Rs in response to the input stereo signals R't and L't and the matrix coefficients generated by the matrix coefficient generator 132. The variable gain signals generator 130 monitors levels of signals according to channels, calculates an optimum linear coefficient value according to the monitored levels of signals according to channels, and reconfigures multichannel audio signals. The matrix coefficient generator 132 increases a level of a channel having a largest level nonlinearly.

However, in a conventional matrix decoding system illustrated in FIG. 1, a position of a virtual sound source generated in a multichannel environment is not considered. Thus, localization of a sound image is not precisely achieved in a space. Furthermore, precisely representing a change in positions of a sound source moving in a virtual space is not easily accomplished. Thus, a capability of dynamically expressing a sound image is insufficient. That is, the conventional matrix decoding system is not capable of restoring a sound image moving between channels so as to restore surround sound and a sound image that exists in a rear channel (a surround channel).

SUMMARY OF THE INVENTION

The present general inventive concept provides a method and apparatus to decode audio matrix in which stereo audio signals are matrix-decoded into multichannel audio signals and a movement path and a change in strength of a sound image are predicted by using a time change rate of the multichannel audio signals.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a method of audio matrix decoding, the method including decoding multichannel signals from stereo signals, extracting strengths and positions of virtual sound sources existing between channels based on power vectors of the decoded multichannel signals, comparing the strengths and positions of an extracted previous and current virtual sound sources to predict position movement and the strengths of the virtual sound sources, and redistributing powers to positions of channel speakers in a multichannel arrangement based on the predicted position of a sound image.

The foregoing and/or other aspects and utilities of the general inventive concept may also be achieved by providing a method of audio matrix decoding, the method including dividing stereo signals according to subbands, decoding each of the stereo signals divided according to the subbands into multichannel signals according to the subbands, extracting strengths and positions of virtual sound sources existing between channels according to the subbands based on power vectors of the decoded multichannel signals according to the subbands, comparing the strengths and positions of the extracted, previous and current virtual sound sources to predict position movement and the strengths of the virtual sound sources according to the subbands, redistributing powers to positions of channel speakers in a multichannel arrangement according to the subbands based on position movement and strengths of the predicted virtual sound sources, and synthesizing audio data of the redistributed multichannel according to the subbands.

The foregoing and/or other aspects and utilities of the general inventive concept may also be achieved by providing an apparatus to decode audio matrix, the apparatus including a passive matrix decoder to decode multichannel signals from stereo signals, a virtual sound source extractor to extract strengths and positions of virtual sound sources existing between channels based on power vectors of the multichannel signals decoded by the passive matrix decoder, a virtual sound source movement tracking unit to compare the strengths and positions of previous and current virtual sound sources extracted by the virtual sound source extractor to predict position movement and the strengths of the virtual sound sources, and a channel power distributor to redistribute powers to positions of channel speakers in a multichannel arrangement based on a position of a sound image predicted by the virtual sound source movement tracking unit.

The foregoing and/or other aspects and utilities of the general inventive concept may also be achieved by providing an apparatus to decode audio matrix, the apparatus including a matrix decoder to matrix-decode stereo audio signals into multichannel audio signals, virtual sound source movement tracking unit to predict a movement path and a change in strength of a sound image by using a time change rate of the multichannel audio signals, and a channel power distributor to redistribute powers to positions of channel speakers in a multichannel arrangement based on the movement path and the change in strength of a sound image predicted by the virtual sound source movement tracking unit.

The foregoing and/or other aspects and utilities of the general inventive concept may also be achieved by providing an audio matrix decoding method including matrix-decode stereo audio signals into multichannel audio signals, predicting a movement path and a change in strength of a sound image by using a time change rate of the multichannel audio signals, and redistributing powers to positions of channel speakers in a multichannel arrangement based on the predicted a movement path and a change in strength of a sound image.

The foregoing and/or other aspects and utilities of the general inventive concept may also be achieved by providing a computer-readable recording medium having embodied thereon a computer program to execute a method, wherein the method including matrix-decode stereo audio signals into multichannel audio signals, and predicting a movement path and a change in strength of a sound image by using a time change rate of the multichannel audio signals.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
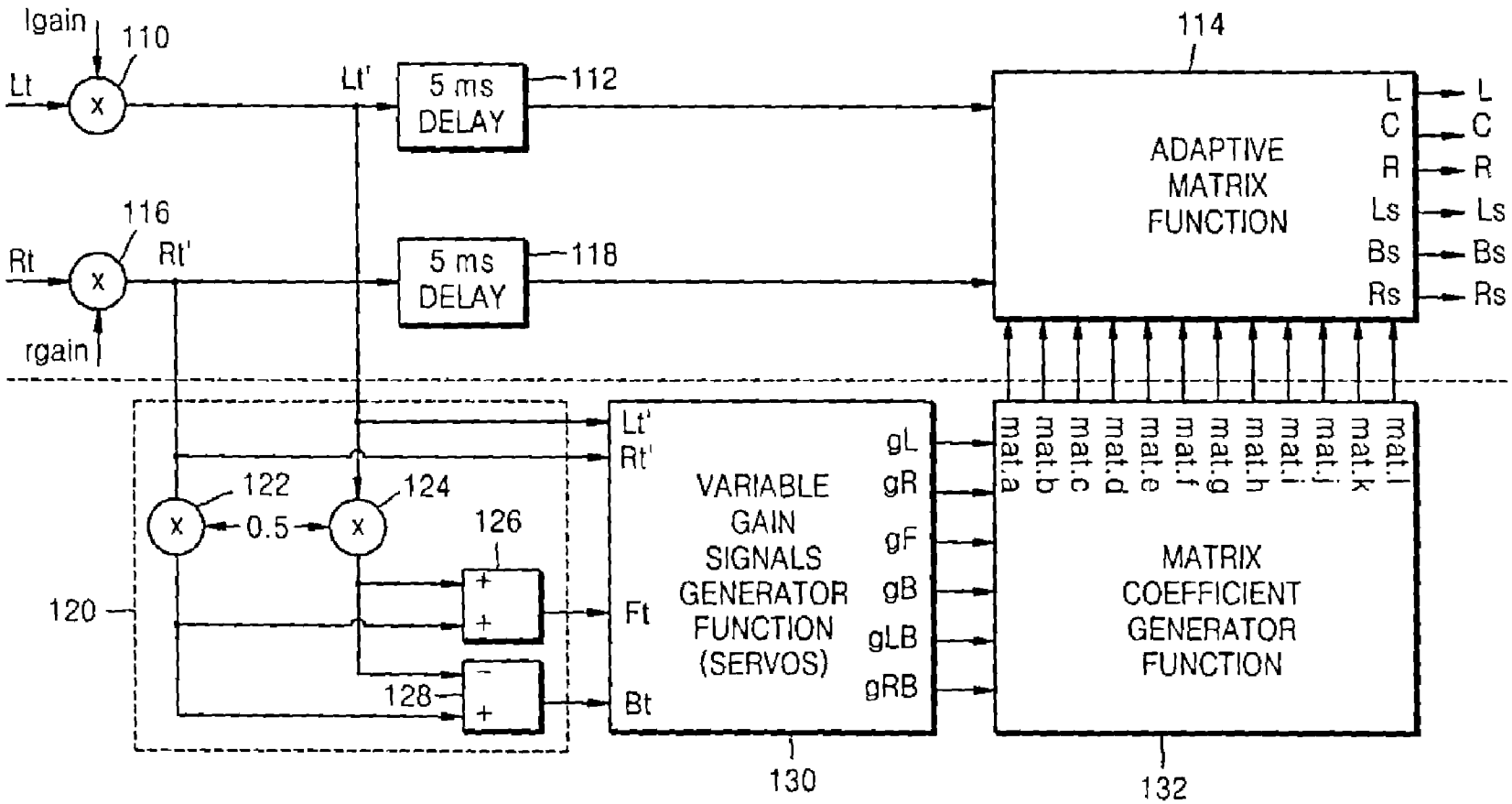
FIG. 1 illustrates a conventional matrix decoder.

The present general inventive concept will now be described more fully with reference to the accompanying drawings, in which exemplary embodiments of the general inventive concept are illustrated.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
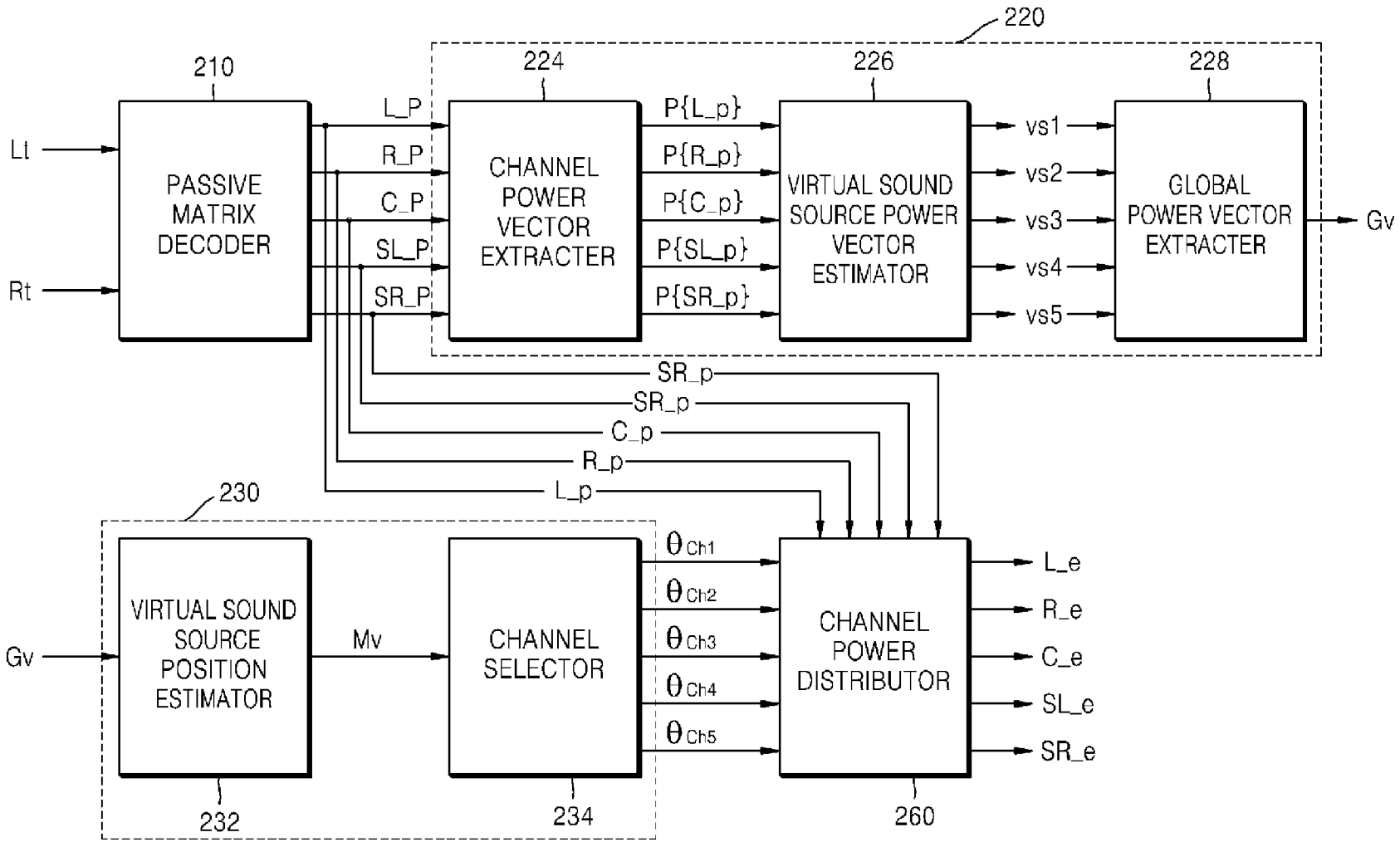
FIG. 2 illustrates an apparatus for audio matrix decoding according to an embodiment of the present general inventive concept.

FIG. 2 illustrates an apparatus for audio matrix decoding according to an embodiment of the present general inventive concept. Referring to FIG. 2, the apparatus for audio matrix decoding includes a passive matrix decoder 210, a virtual sound source extractor 220, a virtual sound source movement tracking unit 230, and a channel power distributor 260.

Furthermore, the virtual sound source extractor 220 includes a channel power vector extractor 224, a virtual sound source power vector estimator 226, and a global power vector extractor 228.

Furthermore, the virtual sound source movement tracking unit 230 includes a virtual sound source position estimator 232 and a channel selector 234.

First, a signal supply device (not illustrated) obtains signals from video tapes, video discs, and satellite broadcasting, etc., to reproduce video signals and audio signals. At this time, the audio signals are stereo signals of two matrix-encoded channels. Lastly, image signals are supplied to a monitor (not illustrated).

The passive matrix decoder 210 decodes matrix-encoded stereo signals Lt and Rt into a left channel signal L_p, a center channel signal C_p, a right channel signal R_p, a left surround channel signal SL_p, and a right surround channel signal SR_p using linear combination of channels.

The virtual sound source extractor 220 extracts the strength and position of a virtual sound source existing between channels based on a power vector of each channel signal decoded by the passive matrix decoder 210.

The virtual sound source extractor 220 will now be described in more detail.

The channel power vector extractor 224 extracts power vectors P{L_p}, P{C_p}, P{R_p}, P{SL_p}, and P{SR_p} of five channels by multiplying magnitudes of channel signals L_p, C_p, R_p, SL_p, and SR_P decoded by the passive matrix decoder 210 by position values obtained by marking positions of speakers as polar coordinates.

The virtual sound source power vector estimator 226 calculates virtual sound source vectors vs1, vs2, vs3, vs4, and vs5 existing between channels from the power vectors P{L_p}, P{C_p}, P{R_p}, P{SL_p}, and P{SR_p} of five channels extracted by the channel power vector extractor 224.

The global power vector extractor 228 extracts a global power vector Gv using a linear combination of virtual sound source vectors vs1, vs2, vs3, vs4, and vs5 calculated by the virtual sound source power vector estimator 226 to determine the position and strength of a sound image which is most dominant among all sound images.

Referring back to FIG. 2, the virtual sound source movement tracking unit 230 compares a strength and position of a previous virtual sound source and the strength and position of a current virtual sound source, which are extracted by the virtual sound source extractor 220, and predicts position movement and strengths of the virtual sound sources.

The virtual sound source movement tracking unit 230 will now be described in more detail.

The virtual sound source position estimator 232 estimates a moving vector Mv which corresponds to a position of a future sound source, by comparing a previous global power vector Gv(t−1) and a current global power vector Gv(t), which are extracted by the global power vector extractor 228.

The channel selector 234 normalizes a speaker position of each channel based on a position of a moved dominant sound image according to time estimated by the virtual sound source position estimator 232. That is, the channel selector 234 selects channels so as to improve gains of signals.

Referring back to FIG. 2, the channel power distributor 260 compares magnitudes of channel signals L_p, C_p, R_p, SL_p, and SR_p decoded by the passive matrix decoder 210 with a magnitude ($Lp^2+R_p^2+C_p^2+SL_p^2+SR_p^2$) of all channel signals to adjust signal gains according to channels and redistributes the signal gains adjusted at the position of each channel selected by the virtual sound source movement tracking unit 230. Thus, the channel power distributor 260 outputs signals L_e, R_e, C_e, SL_e, and SR_e of which gains are redistributed according to channels.

Figure 3:
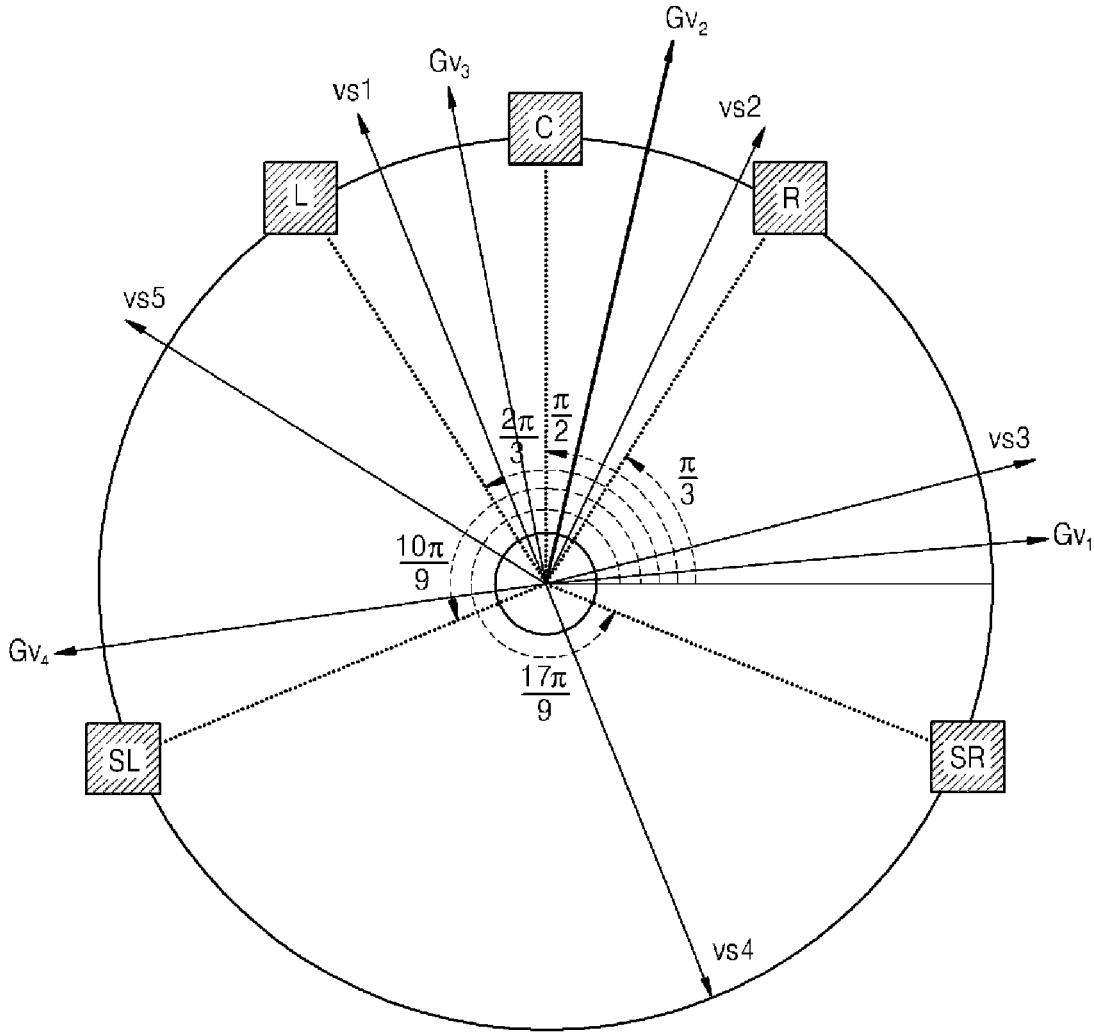
FIG. 3 illustrates redistribution of energy according to speakers according to channels and positions of virtual sound sources according to an embodiment of the present general inventive concept.

FIG. 3 illustrates redistribution of energy with respect to speakers according to channels and positions of virtual sound sources according to an embodiment of the present general inventive concept.

Referring to FIG. 3, positions of speakers L, C, R, SL, and SR of left, center, right, left surround, and right surround channels are marked as polar coordinates. Furthermore, virtual sound source vectors vs1, vs2, vs3, vs4, and vs5 are arranged between channel speakers. Furthermore, the global power vector Gv represents a position of a sound image which is most dominant among all sound images. The position of the sound image is moved in a time sequence, like Gv1→Gv2→Gv3→Gv4 illustrated in FIG. 3.

Thus, signal levels adjusted using gain control functions are redistributed to positions of speakers of channels which are normalized based on the global power vector Gv.

Figure 4:
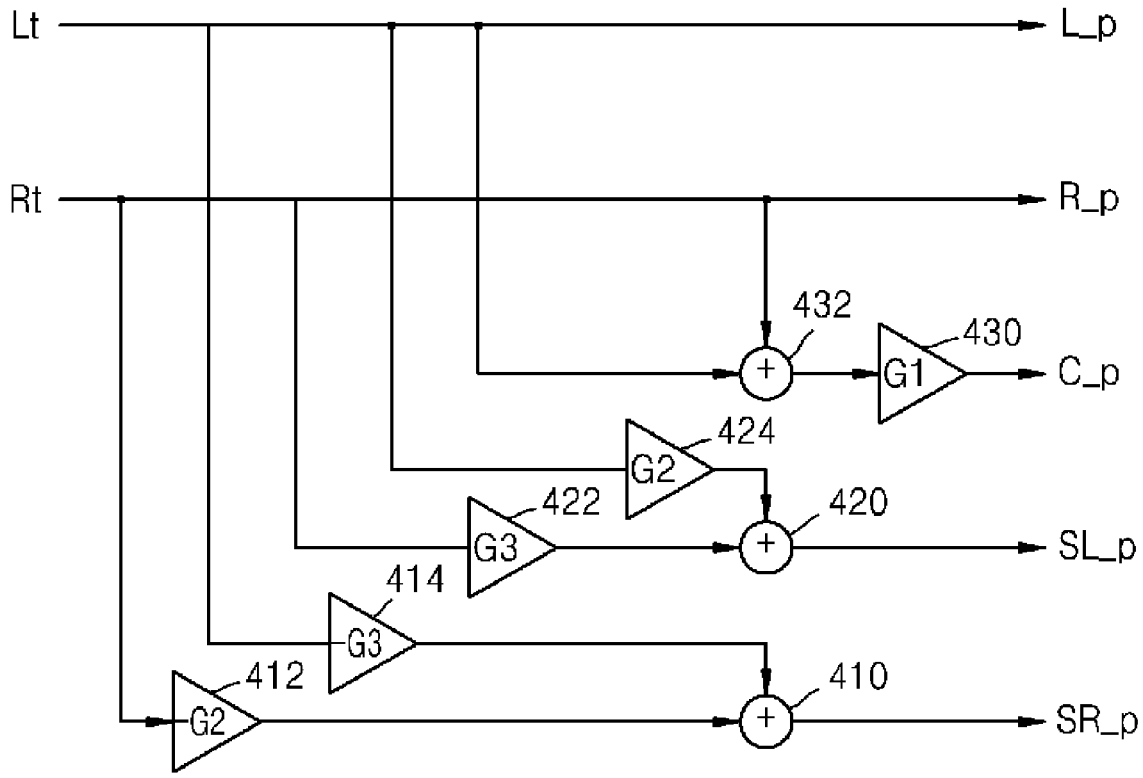
FIG. 4 illustrates a passive matrix decoder of FIG. 2 according to an embodiment of the present general inventive concept.

FIG. 4 illustrates a passive matrix decoder of FIG. 2 according to an embodiment of the present general inventive concept.

Matrix-encoded stereo signals Lt and Rt are decoded into audio signals L_p, C_p, R_p, SL_p, and SR_p of five channels such as left, center, right, left surround, and right surround using linear combination by using multipliers 412, 414, 422, 424, 432, and 430 and adders 410, 420, and 432. For example, L_p=Lt, R_p=Rt, C_p=0.7*(Lt+Rt), SL_p=−0.866Lt+0.5Rt, SR_p=−0.5Lt+0.866Rt.

Figure 5:
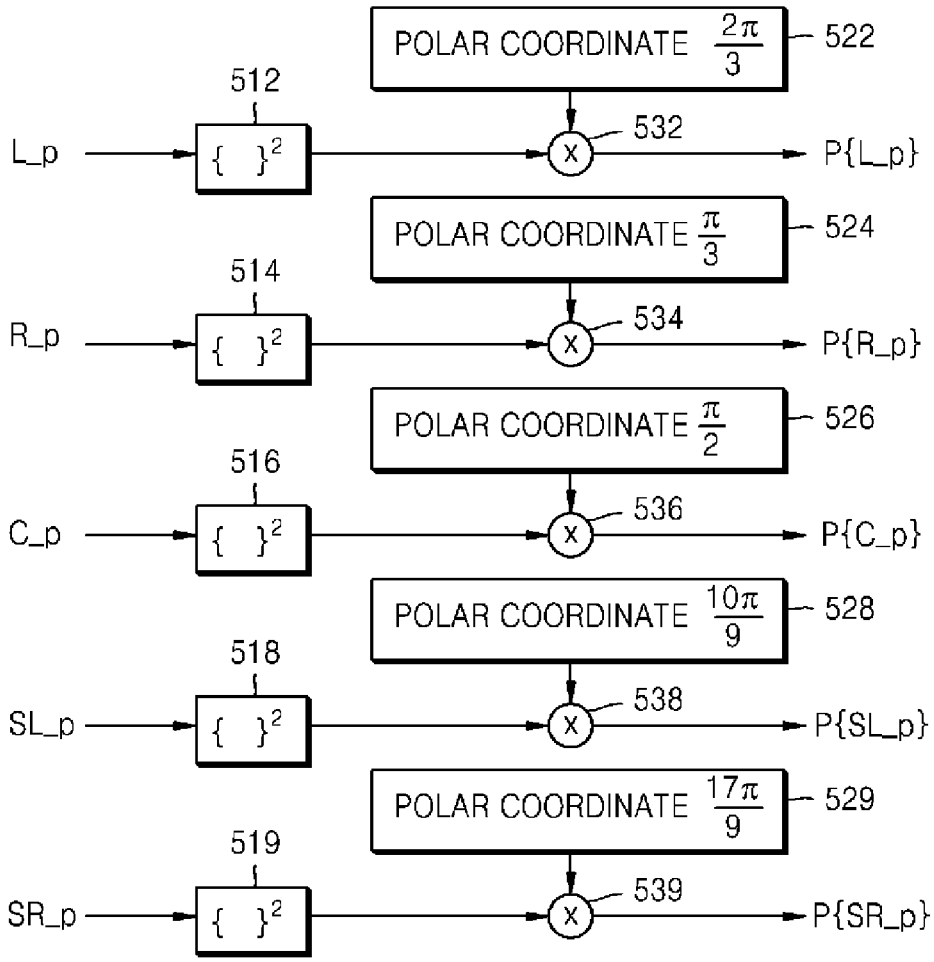
FIG. 5 illustrates a channel power vector extractor of FIG. 2 according to an embodiment of the present general inventive concept.

FIG. 5 illustrates a channel power vector extractor 224 of FIG. 2 according to an embodiment of the present general inventive concept.

Referring to FIG. 5, first, second, third, fourth, and fifth squarers 512, 514, 516, 518, and 519 square signals L_p, C_p, R_p, SL_p, and SR_p of left, center, right, left surround, and right surround channels, which are decoded by the passive matrix decoder 210, to calculate power values thereof.

A first multiplier 532 multiplies a power value of a left channel signal calculated by the first squarer 512 by a polar coordinate value (i.e., 120 degrees) of a predetermined left channel speaker to extract a power vector P{L_p} of a left channel.

A second multiplier 534 multiplies a power value of a right channel signal calculated by the second squarer 514 by a polar coordinate value (i.e., 60 degrees) of a predetermined right channel speaker to extract a power vector P{R_p} of a right channel.

A third multiplier 536 multiplies a power value of a center channel signal calculated by the third squarer 516 by a polar coordinate value (i.e., 90 degrees) of a predetermined center channel speaker to extract a power vector P{C_p} of a center channel.

A fourth multiplier 538 multiplies a power value of a right surround channel signal calculated by the fourth squarer 518 by a polar coordinate value (i.e., 200 degrees) of a predetermined right surround channel speaker to extract a power vector P{SL_p} of a right surround channel.

A fifth multiplier 539 multiplies a power value of a left surround channel signal calculated by the fifth squarer 519 by a polar coordinate value (i.e., 340 degrees) of a predetermined left surround channel speaker to extract a power vector P{SR_p} of a left surround channel.

Figure 6:
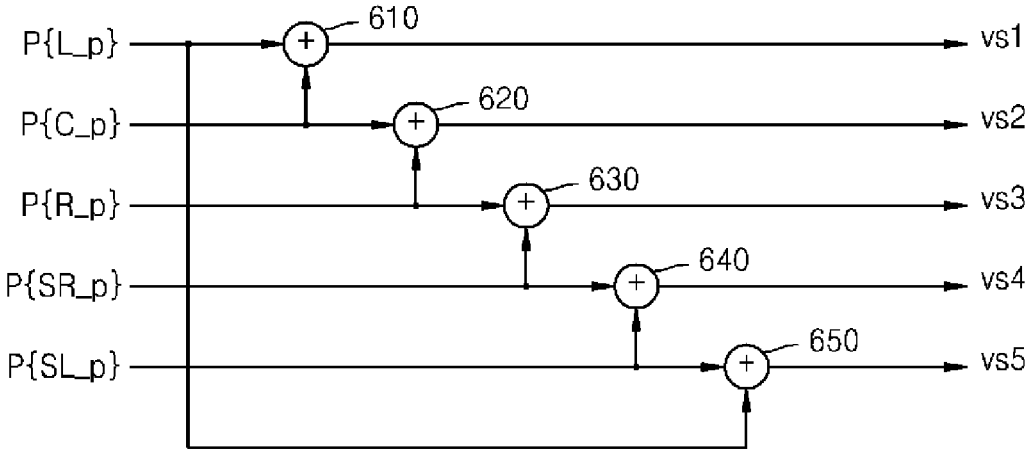
FIG. 6 illustrates a virtual sound source power vector estimator of FIG. 2 according to an embodiment of the present general inventive concept.

FIG. 6 illustrates a virtual sound source power vector estimator 226 of FIG. 2 according to an embodiment of the present general inventive concept.

A first adder 610 extracts a first virtual sound source vector value vs1 by adding a power vector P{L_p} of a left channel to a power vector P{C_p} of a center channel.

A second adder 620 extracts a second virtual sound source vector value vs2 by adding a power vector P{C_p} of a center channel to a power vector P{R_p} of a right channel.

A third adder 630 extracts a third virtual sound source vector value vs3 by adding a power vector P{R_p} of a right channel to a power vector P{SR_p} of a right surround channel.

A fourth adder 640 extracts a fourth virtual sound source vector value vs4 by adding a power vector P{SR_p} of a right surround channel to a power vector P{SL_p} of a left surround channel.

A fifth adder 650 extracts a fifth virtual sound source vector value vs5 by adding a power vector P{SL_p} of a left surround channel to a power vector P{L_p} of a left channel.

Figure 7:
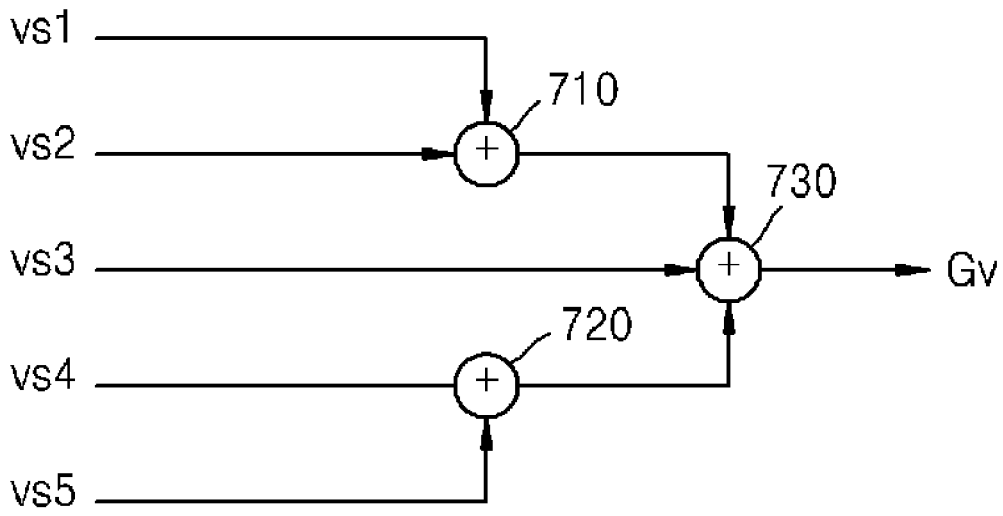
FIG. 7 illustrates a global power vector extractor of FIG. 2 according to an embodiment of the present general inventive concept.

FIG. 7 illustrates a global power vector extractor 228 of FIG. 2 according to an embodiment of the present general inventive concept.

First, second, third, fourth, and fifth virtual sound source vector values vs1, vs2, s3, vs4, and vs5 are linearly combined by adders 710, 720, and 730 and are generated as a global power vector Gv. The global power vector Gv represents the position and magnitude of a sound image which is most dominant among all sound images, as illustrated in FIG. 3.

Figure 8:
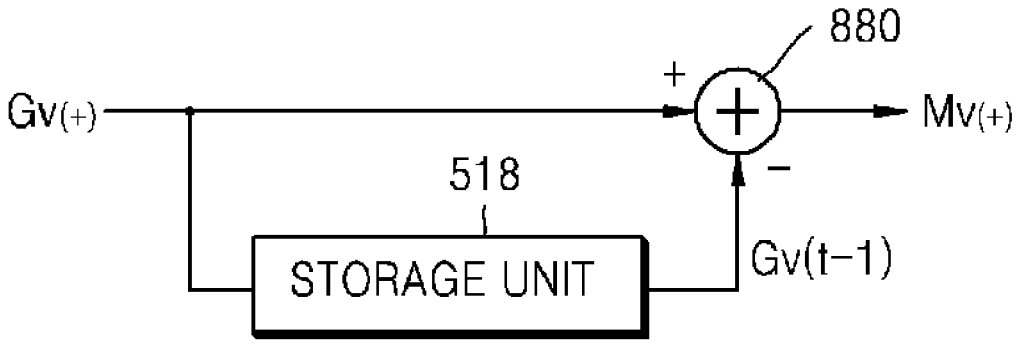
FIG. 8 illustrates a virtual sound source position estimator of FIG. 2 according to an embodiment of the present general inventive concept.

FIG. 8 illustrates a virtual sound source position estimator 232 of FIG. 2 according to an embodiment of the present general inventive concept.

A storage unit 810 stores a global power vector Gv which corresponds to a position and strength of an input virtual sound source, for a predetermined amount of time.

A subtracter 820 subtracts a previous global power vector Gv(t−1) stored in the storage unit 810 from an input, current global power vector Gv(t) to obtain a moving vector Mv(t). The moving vector Mv(t) corresponds to the position and strength of a future sound source.

Figure 9:
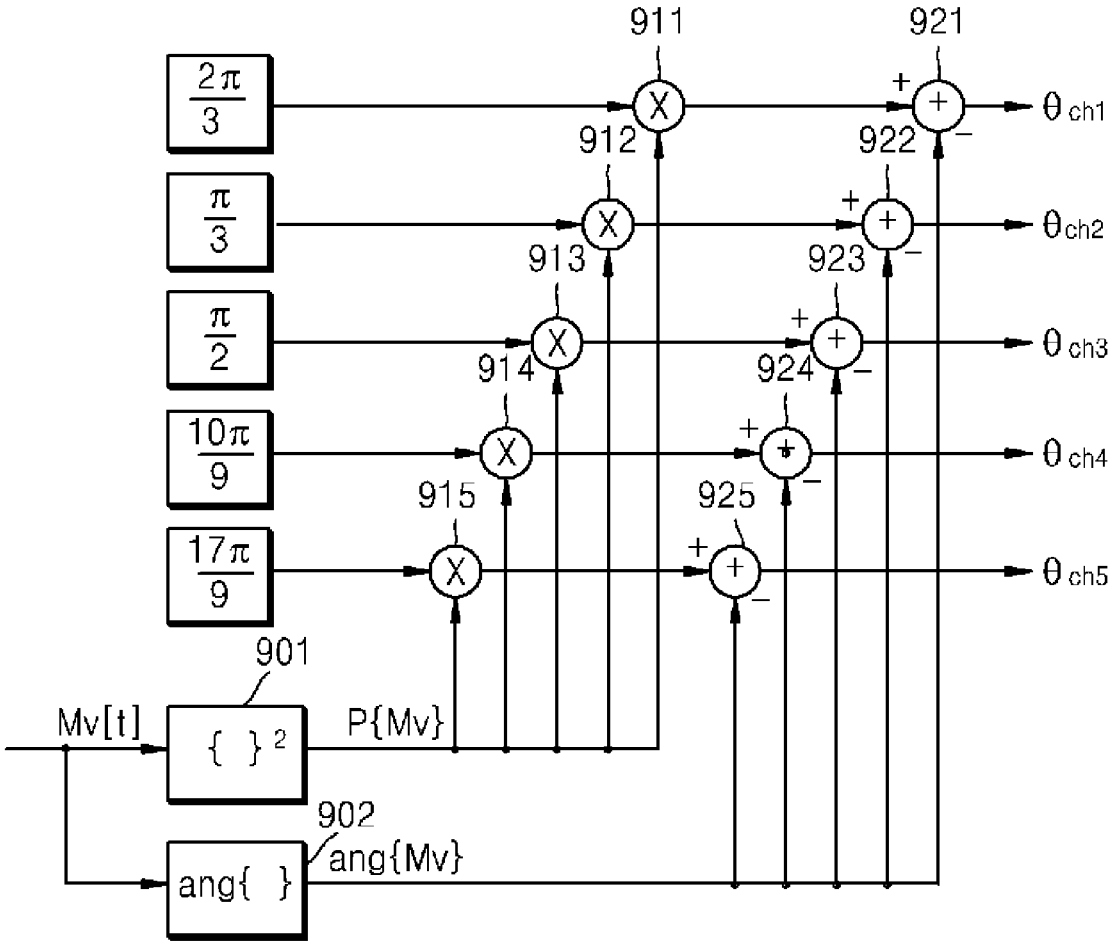
FIG. 9 illustrates a channel selector of FIG. 2 according to an embodiment of the present general inventive concept.

FIG. 9 illustrates a channel selector 234 of FIG. 2 according to an embodiment of the present general inventive concept.

A squarer 901 squares a moving vector Mv(t) to obtain a power value P{Mv}.

A position extractor 902 extracts the moving vector Mv(t) as a position value.

A first multiplier 911 multiplies a position value of a left channel speaker by the power value P{Mv} of the moving vector Mv(t).

A second multiplier 912 multiplies a position value of a right channel speaker by the power value P{Mv} of the moving vector Mv(t).

A third multiplier 913 multiplies a position value of a center channel speaker by the power value P{Mv} of the moving vector Mv(t).

A fourth multiplier 914 multiplies a position value of a left surround channel speaker by the power value P{Mv} of the moving vector Mv(t).

A fifth multiplier 915 multiplies a position value of a right surround channel speaker by the power value P{Mv} of the moving vector Mv(t).

A first subtracter 921 subtracts a position value ang{Mv} of the moving vector Mv(t) from an output value of the first multiplier 911 to obtain a position $\theta_{ch1}$ of a normalized left channel speaker.

A second subtracter 922 subtracts a position value ang{Mv} of the moving vector Mv(t) from an output value of the second multiplier 912 to obtain a position $\theta_{ch2}$ of a normalized right channel speaker.

A third subtracter 923 subtracts a position value ang{Mv} of the moving vector Mv(t) from an output value of the third multiplier 913 to obtain a position $\theta_{ch3}$ of a normalized center channel speaker.

A fourth subtracter 924 subtracts a position value ang{Mv} of the moving vector Mv(t) from an output value of the fourth multiplier 914 to obtain a position $\theta_{ch4}$ of a normalized left surround channel speaker.

A fifth subtracter 925 subtracts a position value ang{Mv} of the moving vector Mv(t) from an output value of the fifth multiplier 915 to obtain a position $\theta_{ch5}$ of a normalized right surround channel speaker.

Figure 10:
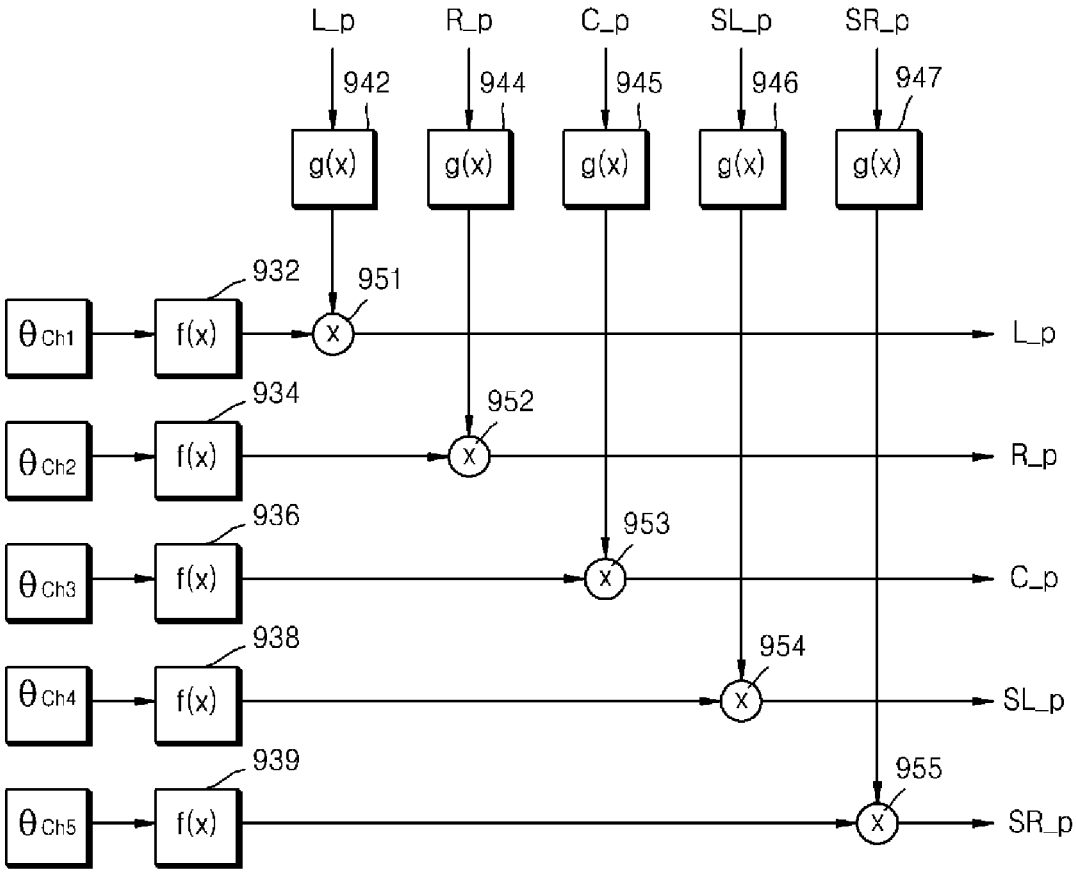
FIG. 10 illustrates a channel power distributor of FIG. 2 according to an embodiment of the present general inventive concept.

FIG. 10 illustrates a channel power distributor 260 of FIG. 2 according to an embodiment of the present general inventive concept.

First, second, third, fourth, and fifth multipliers 951, 952, 953, 954, and 955 respectively multiply disposition functions f(x) 931, 932, 933, 934, and 935 having position values $\theta_{ch1}$, $\theta_{ch2}$, $\theta_{ch3}$, $\theta_{ch4}$, $\theta_{ch5}$ of normalized channels as parameters by gain control functions g(x) 951, 952, 953, 954, and 955 having magnitudes L_p, R_p, C_p, SL_p, and SR_p of decoded channel signals as parameters to output signals L_e, R_e, C_e, SL_e, and SR_e of redistributed channels.

In this case, the gain control functions g(x) are used to compare the magnitude of all decoded channel signals with the magnitude of each channel signal to control the magnitude of each channel signal according to the ratio of the magnitude of each channel signal to the magnitudes of all channel signals. For example, when the magnitude R_p of a right channel signal is equal to or greater than 20% of the magnitude ($L_p^2+R_p^2+C_p^2+SL_p^2+SR_p^2$) of all channel signals, the magnitude R_p of the right channel signal is increased in proportion to an algebraic function. When the magnitude R_p of a right channel signal is equal to or less than 20% of the magnitude ($L_p^2+R_p^2+C_p^2+SL_p^2+SR_p^2$) of all channel signals, the magnitude R_p of the right channel signal is decreased in proportion to an algebraic function.

Figure 11:
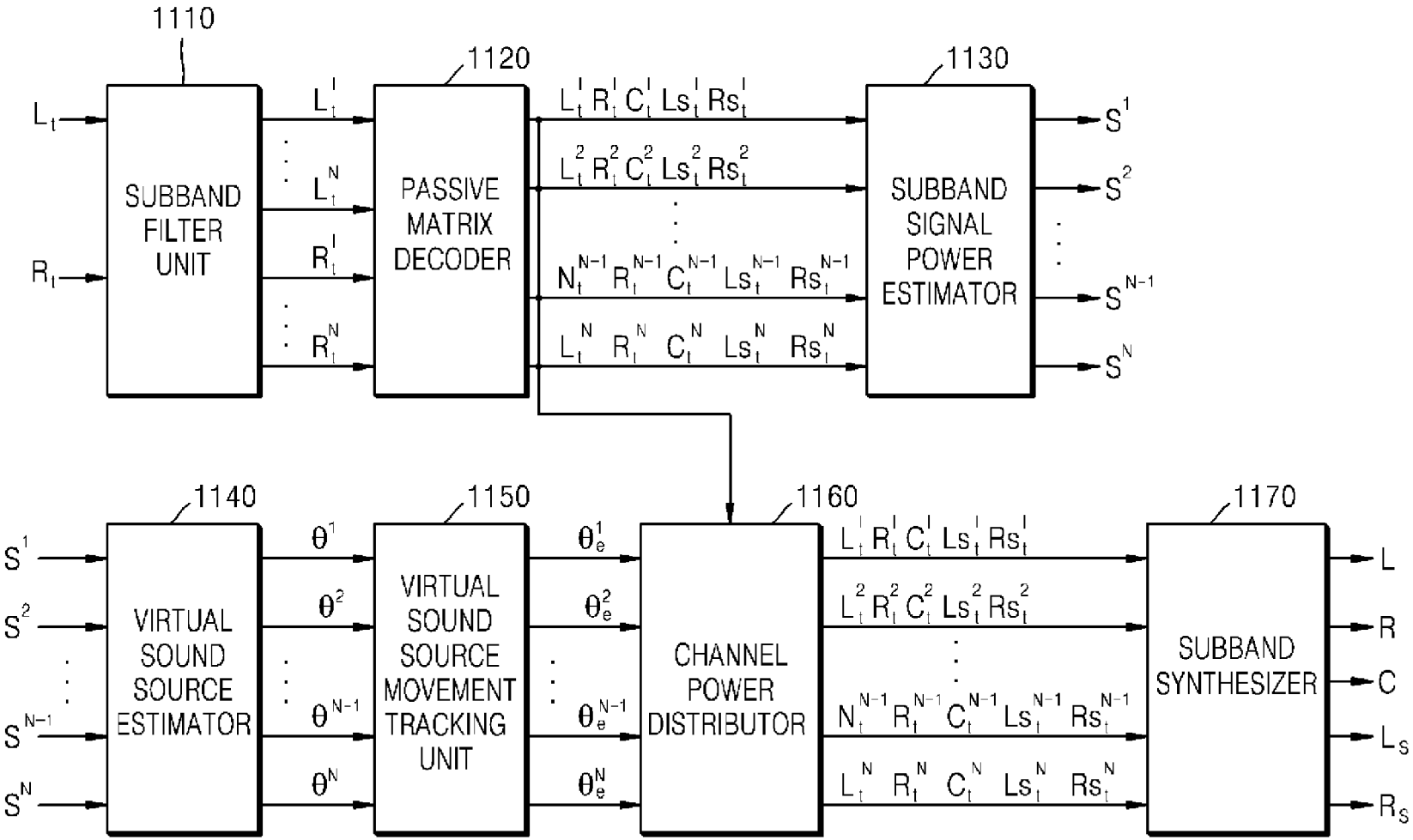
FIG. 11 illustrates an apparatus for audio matrix decoding according to another embodiment of the present general inventive concept.

FIG. 11 illustrates an apparatus for audio matrix decoding according to another embodiment of the present general inventive concept. Referring to FIG. 11, the apparatus for audio matrix decoding includes a subband filter unit 1110, a passive matrix decoder 1120, a subband signal power estimator 1130, a virtual sound source extractor 1140, a virtual sound source movement tracking unit 1150, a channel power distributor 1160, and a subband synthesizer 1170.

The subband filter unit 1110 divides matrix-encoded stereo signals Lt and Rt into N subbands using linear combination of channels. Thus, the stereo signals Lt and Rt are divided into stereo signals $L_t^1 \ldots L_t^N$ and $R_t^1 \ldots R_t^N$ according to subbands.

The passive matrix decoder 1120 decodes each of the stereo signals divided by the subband filter unit 1110 according to subbands into each of multichannel signals $L_t^1 \ldots L_t^N$, $R_t^1 \ldots R_t^N$, $C_t^1 \ldots C_t^N$, $Ls_t^1 \ldots Ls_t^N$, and $Rs_t^1 \ldots Rs_t^{NA}$.

The subband signal power estimator 1130 estimates powers $S^1 \ldots S^N$ of multichannel signals decoded by the passive matrix decoder 1120 according to subbands.

The virtual sound source extractor 1140 extracts strengths and position values $\theta^1 \ldots \theta^N$ of virtual sound sources existing between channels according to subbands based on powers of multichannel signals estimated by the subband signal power estimator 1130 according to subbands.

The virtual sound source movement tracking unit 1150 compares the strength and position of a previous virtual sound source and the strength and position of a current virtual sound source, which are extracted by the virtual sound source estimator 1140, and predicts position movement and strength values $\theta_e^1 \ldots \theta_e^N$ of the virtual sound sources according to subbands. For example, the virtual sound source movement tracking unit 1150 compares a previous global power vector Gv(t−1) and a current global power vector Gv(t) according to subbands and estimates a position of a future sound source which corresponds to a moving vector.

The channel power distributor 1160 redistributes powers to positions of multichannel speakers according to subbands based on the multichannel signals decoded by the passive matrix decoder 1120 and a position movement and strength values of the virtual sound sources predicted by the virtual sound source movement tracking unit 1150. Thus, the channel power distributor 1160 outputs signals $L_t^1 \ldots L_t^N$, $R_t^1 \ldots R_t^N$, $C_t^1 \ldots C_t^N$, $Ls_t^1 \ldots Ls_t^N$, $Rs_t^1 \ldots Rs_t^N$, the gains of which are redistributed according to channels.

The subband synthesizer 1170 synthesizes multichannel audio data redistributed by the channel power distributor 1160 according to subbands in order to generate multichannel audio signals L, R, C, Ls, and Rs.

Figure 12:
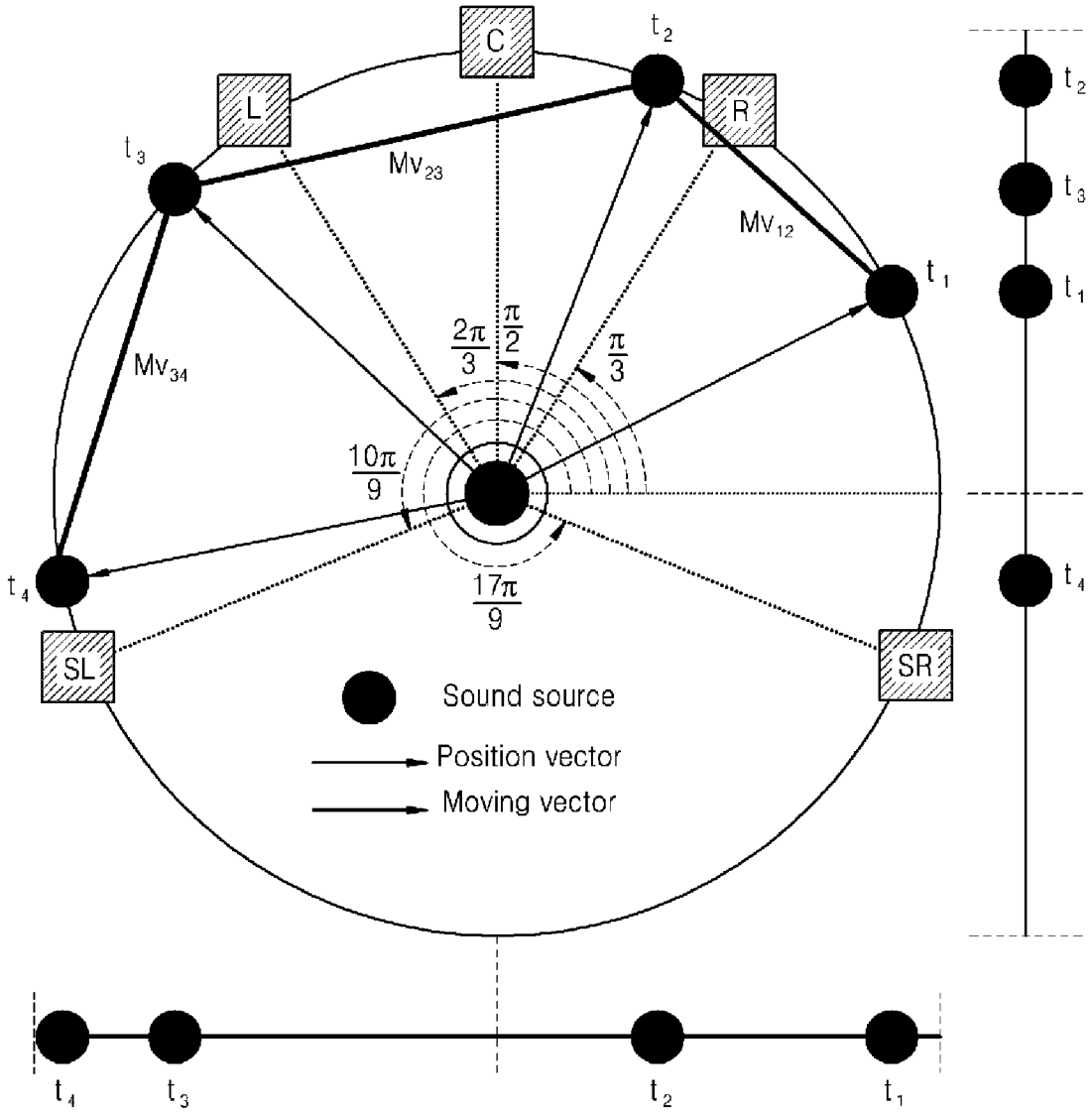
FIG. 12 illustrates redistribution of channels according to strengths of sound sources and use of position change tracking according to an embodiment of the present general inventive concept.

FIG. 12 illustrates redistribution of channels according to strengths of sound sources and use of position change tracking according to an embodiment of the present general inventive concept.

Referring to FIG. 12, when a position of a multichannel virtual sound source is moved from time t1 to t3, a moving vector which represents a movement path of a sound image may be indicated by $Mv_{12}$ and $Mv_{13}$. In this case, a position of the sound image may be moved in a same rotation direction as $Mv_{12}$ and $Mv_{13}$ using the virtual sound source position estimator 232 is predicted. Thus, a position of the sound image at time t4 may be close to a left surround channel SL. A change in positions of a sound image occurs frequently while multichannel sound signals in which a movement of a sound image occurs frequently, are moved from forward to backward. However, in a conventional matrix decoding method, a sound image is moved only at a front channel (i.e., between right and left channels). According to the present embodiment, a movement of a sound image is traced and a position of the sound image after a current time is predicted so that the sound image can be moved to a rear channel (i.e., left surround and right surround channels). Thus, when the predicted position of the sound image is close to the rear channel, better sound image localization is achieved and channel separation is improved by using redistribution of energy according to channels.

Figure 13:
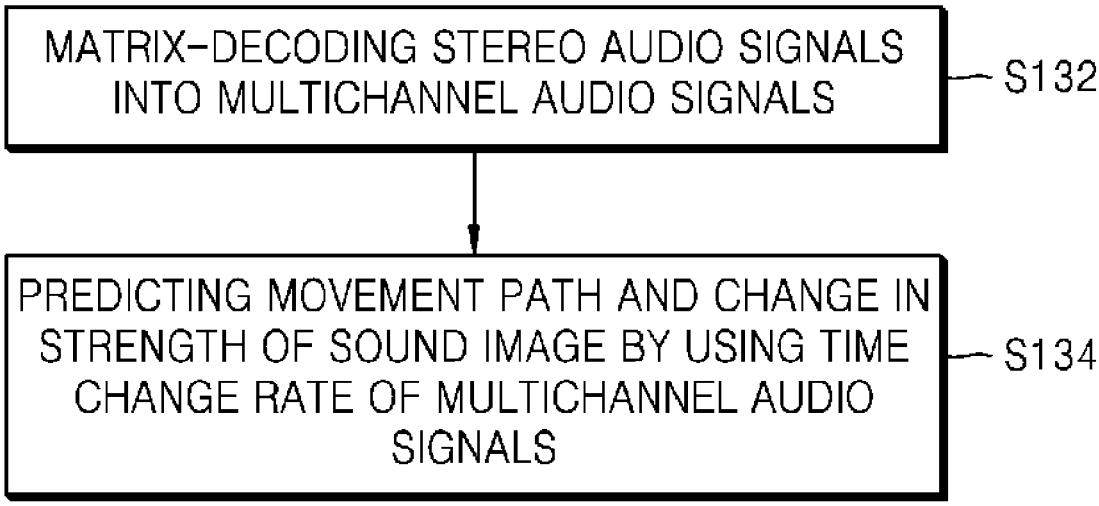
FIG. 13 is a flowchart illustrating an audio matrix decoding method according to an embodiment of the present general inventive concept.

FIG. 13 is a flowchart illustrating an audio matrix decoding method according to an embodiment of the present general inventive concept. Referring to FIG. 13, in operation S132, stereo audio signals are matrix-decoded, for example, by a matrix decoder 210, into multichannel audio signals. In operation S134, a movement path and a change in strength of a sound image are predicted, for example, by a virtual sound source movement tracking unit, 230 (FIG. 2) by using a time change rate of the multichannel audio signals.

The general inventive concept can also be embodied as computer-readable codes on a computer-readable recording medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, according to various embodiments of the present general inventive concept, a movement path and a change in strength of a sound image can be predicted using a time change rate of multichannel signals that pass a general passive matrix. Thus, the passive matrix decoder according to the present general inventive concept predicts a movement time of a sound image to a rear channel so as to prevent a sound image from being localized only at a front channel and realizes a surround sound effect by using redistribution of energy according to channels at the movement time of the sound image. Furthermore, subband filtering is applied to the audio matrix decoder according to the present general inventive concept so that a movement of a plurality of virtual sound images can be effectively restored.

While this present general inventive concept has been particularly illustrated and described with reference to exemplary embodiments thereof, it will be understood by those of ordinary skill in the art that various changes in form and details may be made therein without departing from the spirit and scope of the general inventive concept as defined by the appended claims. Therefore, the scope of the general inventive concept is defined only by the appended claims, and all differences within the scope will be construed as being included in the present general inventive concept.

What is claimed is:

1. A method of audio matrix decoding, the method comprising:

decoding multichannel signals from stereo signals;

extracting strengths and positions of virtual sound sources existing between channels based on power vectors of the decoded multichannel signals;

comparing the strengths and positions of the extracted previous and current virtual sound sources to predict position movement and the strengths of the virtual sound sources; and redistributing powers to positions of channel speakers in a multichannel arrangement based on the predicted position of a sound image.

2. The method of claim 1, wherein the extracting of the strengths and positions of the virtual sound sources comprises:

multiplying magnitudes of the decoded multichannel signals by positions of the plurality of channel speakers to extract power vectors of signals according to the channels;

linearly combining the extracted power vectors of the channels to extract vectors of virtual sound sources existing between the channels; and extracting vector values of a dominant sound image by using a linear combination of the extracted vectors of the virtual sound sources.

3. The method of claim 2, wherein the extracting of the power vectors comprises:

squaring the decoded multichannel signals to calculate power values thereof; and multiplying a position vector of each of the channel speakers in a form of polar coordinates by the power values to calculate power vectors of the signals according to the channels.

4. The method of claim 2, wherein the extracting of the virtual sound source vectors comprises:

adding a power vector value of a predetermined channel to a power vector value of a respective channel adjacent to the channel.

5. The method of claim 1, wherein the predicting of position movement and strings of the virtual sound sources comprises:

storing global power values which correspond to positions and strengths of input virtual sound sources;

subtracting the stored, previous global power vectors from input, current global power vectors to estimate moving vector values; and selecting respective channels to improve gains of signals based on the moving vector values and the position values according to the channels.

6. The method of claim 5, wherein the selecting of the channels comprises:

multiplying a respective position value of a predetermined channel speaker by a power value of the estimated moving dominant vector; and subtracting a position value of the estimated moving vector from the multiplied value.

7. The method of claim 1, wherein the distributing of the powers comprises:

comparing a magnitude of all of the decoded multichannel signals with a magnitude of each channel signal to adjust the magnitude of each channel signal according to a ratio of the magnitude of each channel signal to the magnitude of all of the decoded multichannel signals; and multiplying the adjusted magnitude of each channel signal by a position value of each of normalized channels.

8. A method of audio matrix decoding, the method comprising:

dividing stereo signals according to subbands;

decoding each of the stereo signals divided according to the subbands into multichannel signals according to the subbands;

extracting strengths and positions of virtual sound sources existing between channels according to the subbands based on power vectors of the decoded multichannel signals according to the subbands;

comparing the strengths and positions of the extracted, previous and current virtual sound sources to predict position movement and the strengths of the virtual sound sources according to the subbands;

redistributing powers to positions of channel speakers in a multichannel arrangement according to the subbands based on position movement and strengths of the predicted virtual sound sources; and synthesizing audio data of the redistributed multichannel according to the subbands.

9. An apparatus for audio matrix decoding, the apparatus comprising:

a passive matrix decoder to decode multichannel signals from stereo signals;

a virtual sound source extractor to extract strengths and positions of virtual sound sources existing between channels based on power vectors of the multichannel signals decoded by the passive matrix decoder;

a virtual sound source movement tracking unit to compare the strengths and positions of the previous and current virtual sound sources extracted by the virtual sound source extractor to predict position movement and the strengths of the virtual sound sources; and a channel power distributor to redistribute powers to positions of channel speakers in a multichannel arrangement based on the position of a sound image predicted by the virtual sound source movement tracking unit.

10. The apparatus of claim 9, wherein the virtual sound source movement tracking unit comprises:

a virtual sound source position estimator to estimate the position of a moving sound image by comparing the strengths and positions of a previous virtual sound source and a current virtual sound source; and a channel selector to select channels to improve gains of signals based on the position of the moving sound image estimated by the virtual sound source position estimator.

11. The apparatus of claim 10, wherein the virtual sound source position estimator comprises:

a storage unit to store a dominant vector which corresponds to positions and strengths of input virtual sound sources; and a subtracter to subtract a previous dominant vector stored in the storage unit from an input, current dominant vector to estimate moving vector values.

12. The apparatus of claim 10, wherein the channel selector comprises:

a multiplier to multiply a position value of a predetermined channel speaker by a power value of the moving dominant vector estimated by the virtual sound source position estimator; and a subtracter to subtract a position value of the moving dominant vector estimated by the virtual sound source position estimator from the multiplied value by the multiplier.

13. An apparatus for audio matrix decoding, the apparatus comprising:

a subband filter unit to divide stereo signals according to subbands;

a passive matrix decoder to decode each of the stereo signals divided by the subband filter unit according to the subbands into multichannel signals;

a subband signal power estimator to estimate powers of the multichannel signals decoded by the passive matrix decoder according to subbands;

a virtual sound source extractor to extract strengths and positions of virtual sound sources existing between channels based on power vectors of the multichannel signals estimated by the subband signal power estimator;

a virtual sound source movement tracking unit comparing the strengths and positions of previous and current virtual sound sources extracted by the virtual sound source extractor to predict position movement and the strengths of the virtual sound sources according to the subbands; and a channel power distributor redistributing powers to positions of channel speakers in a multichannel arrangement according to the subbands based on position movement and the strengths of the virtual sound sources predicted by the virtual sound source movement tracking unit; and a subband synthesizer to synthesize audio data of the multichannel redistributed by the channel power distributor according to the subbands.

14. An apparatus to decode audio matrix, the apparatus comprising:

a matrix decoder to matrix-decode stereo audio signals into multichannel audio signals;

virtual sound source movement tracking unit to predict a movement path and a change in strength of a sound image by using a time change rate of the multichannel audio signals; and a channel power distributor to redistribute powers to positions of channel speakers in a multichannel arrangement based on the movement path and the change in strength of a sound image predicted by the virtual sound source movement tracking unit.

15. An audio matrix decoding method, comprising:

matrix-decode stereo audio signals into multichannel audio signals;

predicting a movement path and a change in strength of a sound image by using a time change rate of the multichannel audio signals; and redistributing powers to positions of channel speakers in a multichannel arrangement based on the predicted a movement path and a change in strength of a sound image.

16. A non-transitory computer-readable recording medium having embodied thereon a computer program to execute a method, wherein the method comprises:

matrix-decode stereo audio signals into multichannel audio signals; and predicting a movement path and a change in strength of a sound image by using a time change rate of the multichannel audio signals.

17. An apparatus of audio matrix decoding to receive multichannel signals decoded from stereo signals, the apparatus comprising:

a channel power distributor to redistribute powers to positions of channel speakers corresponding to the multichannel signals based on a movement path and a change in strength of a sound image predicted by using a time change rate of the multichannel signals.

* * * * *